US012102122B2

(12) United States Patent
Seo et al.

(10) Patent No.: US 12,102,122 B2
(45) Date of Patent: Oct. 1, 2024

(54) AEROSOL-GENERATING ARTICLE WITH ENHANCED VAPOR PRODUCTION

(71) Applicant: KT&G CORPORATION, Daejeon (KR)

(72) Inventors: Jung Kyu Seo, Daejeon (KR); Tae Chul Shin, Daejeon (KR); Hee Tae Jung, Daejeon (KR); Young Rim Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 473 days.

(21) Appl. No.: 17/431,602

(22) PCT Filed: Mar. 8, 2021

(86) PCT No.: PCT/KR2021/002809
§ 371 (c)(1),
(2) Date: Aug. 17, 2021

(87) PCT Pub. No.: WO2021/256664
PCT Pub. Date: Dec. 23, 2021

(65) Prior Publication Data

US 2022/0400751 A1 Dec. 22, 2022

(30) Foreign Application Priority Data

Jun. 15, 2020 (KR) ..... 10-2020-0072128

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
CPC ..... A24F 40/40; A24F 40/20; A24F 40/10; A24F 40/00
See application file for complete search history.

(56) References Cited

U.S. PATENT DOCUMENTS 10,149,495 B2 12/2018 Mironov
10,820,625 B2 11/2020 Lindholm Delaloye et al.
(Continued)

FOREIGN PATENT DOCUMENTS

JP 2016-531572 A 10/2016
JP 2019-618450 A 7/2019
(Continued)

OTHER PUBLICATIONS

Office Action dated Oct. 11, 2022 issued by the Japanese Patent Office in Japanese Application No. 2021-532486.
(Continued)

*Primary Examiner* — Alex B Efta
(74) *Attorney, Agent, or Firm* — Sughrue Mion, PLLC

(57) ABSTRACT

Provided herein is an aerosol-generating article with enhanced vapor production. The aerosol-generating article according to some embodiments of the present disclosure includes a medium portion, a support structure which is disposed downstream of the medium portion and includes a first tubular structure having a first hollow formed therein, a cooling structure which is disposed downstream of the support structure and includes a second tubular structure having a second hollow formed therein, and a mouthpiece portion which is disposed downstream of the cooling structure. Here, an upstream end of the second tubular structure may abut a downstream end of the first tubular structure, and an average cross-sectional area of the second hollow may be larger than an average cross-sectional area of the first hollow. The cross-sectional area difference enhances an air
(Continued)

flow diffusion effect, thereby eventually improving vapor production of the aerosol-generating article.

12 Claims, 5 Drawing Sheets

(56) References Cited

U.S. PATENT DOCUMENTS

| | | | | |
|---|---|---|---|---|
| 2009/0065011 | A1* | 3/2009 | Maeder | A24D 1/22 131/194 |
| 2015/0289566 | A1* | 10/2015 | Carraro | A24C 5/47 131/281 |
| 2016/0073684 | A1* | 3/2016 | Mironov | A24C 5/474 131/58 |
| 2016/0192704 | A1 | 7/2016 | Bonnely | |
| 2018/0310624 | A1* | 11/2018 | Parker | A24C 5/01 |
| 2019/0075845 | A1 | 3/2019 | Malgat et al. | |
| 2021/0000168 | A1 | 1/2021 | Seo et al. | |
| 2021/0227876 | A1 | 7/2021 | Hwang et al. | |

FOREIGN PATENT DOCUMENTS

| | | | |
|---|---|---|---|
| JP | WO2020/100872 | A1 | 5/2020 |
| KR | 10-2004-0097132 | A | 11/2004 |
| KR | 10-2014-0118982 | A | 10/2014 |
| KR | 10-2019-0136989 | A | 12/2019 |
| KR | 10-2103706 | B1 | 4/2020 |
| KR | 10-2020-0061072 | A | 6/2020 |
| KR | 10-2020-0061098 | A | 6/2020 |
| KR | 10-2020-0066007 | A | 6/2020 |
| WO | 03/071886 | A1 | 9/2003 |
| WO | 2009/031246 | A1 | 3/2009 |
| WO | 2017/207586 | A1 | 12/2017 |
| WO | 2020/009415 | A1 | 1/2020 |
| WO | 2020/115155 | A1 | 6/2020 |

OTHER PUBLICATIONS

Office Action dated Sep. 29, 2022 issued by the Korean Patent Office in Korean Application No. 10-2020-0072128.

International Search Report for PCT/KR2021/002809, dated Jul. 1, 2021.

Extended European Search Report issued May 18, 2022 in European Application No. 21739897.3.

Office Action issued Mar. 22, 2022 in Korean Application No. 10-2020-0072128.

Communication dated Apr. 4, 2023, issued by the Japanese Patent Office in Application No. 2021-532486.

* cited by examiner

[FIG. 1]
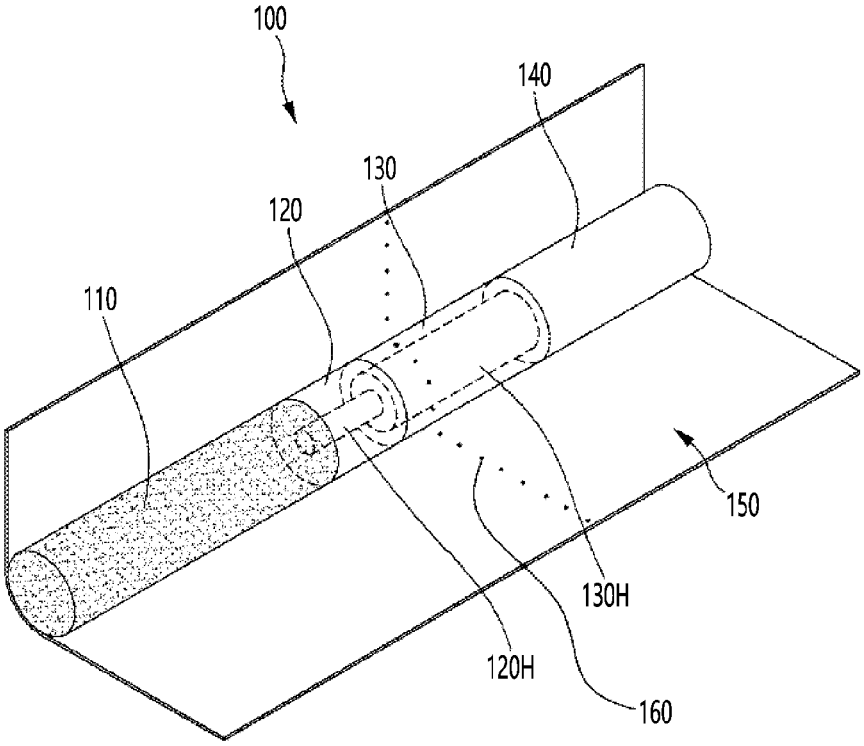
[FIG. 2]
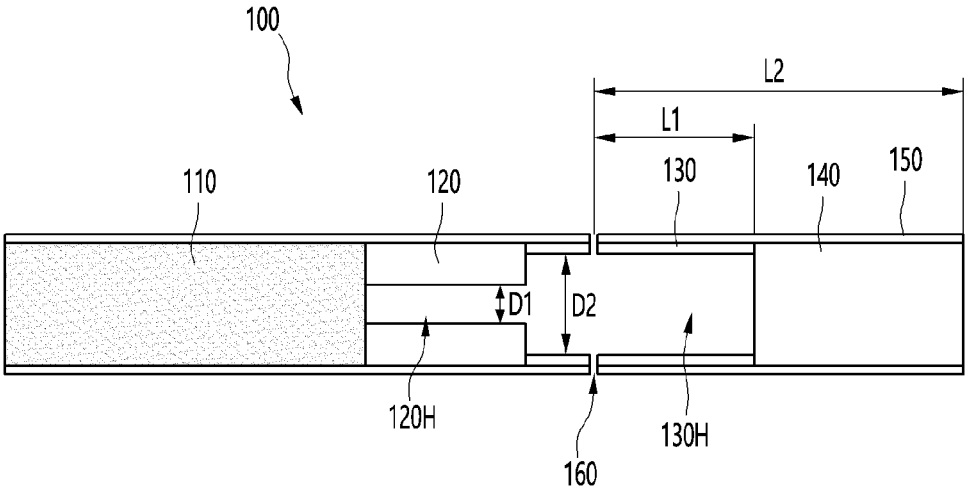

[FIG. 3]
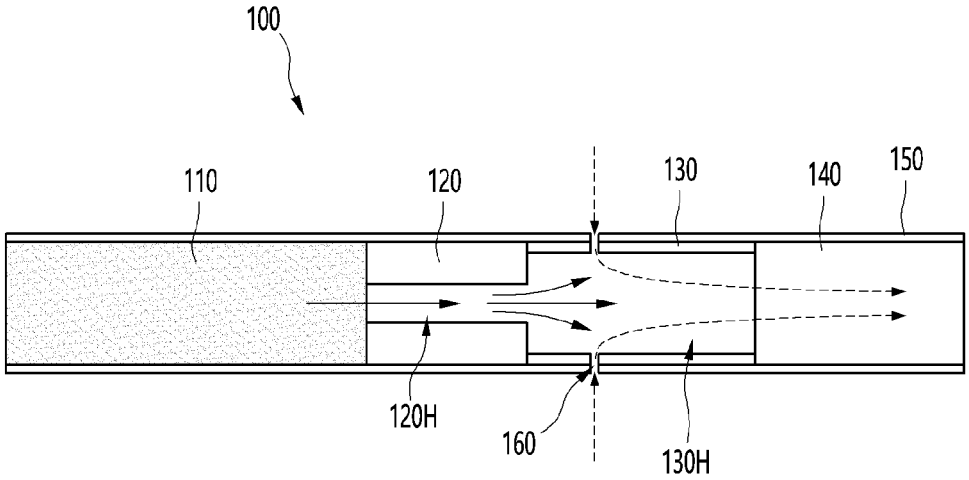
[FIG. 4]
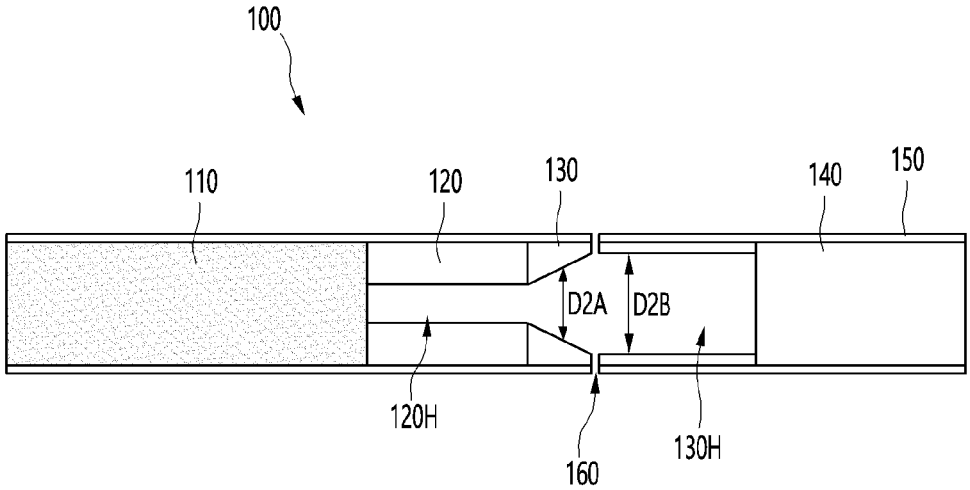

[FIG. 5]
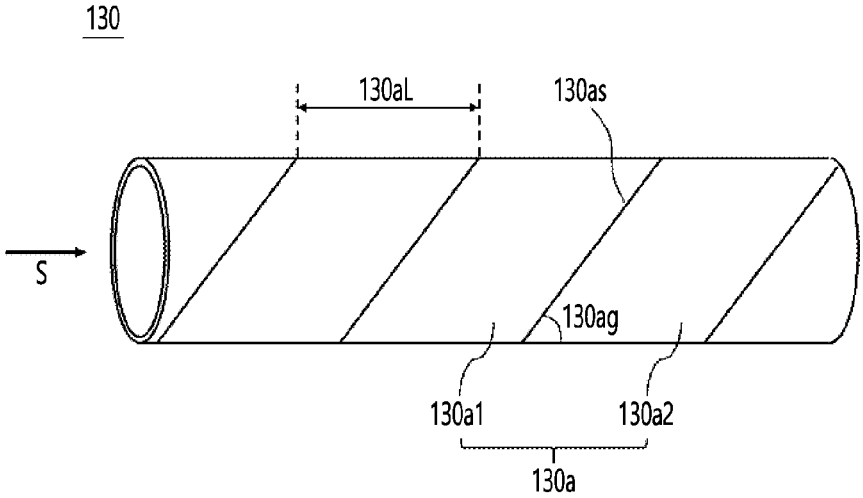
[FIG. 6]
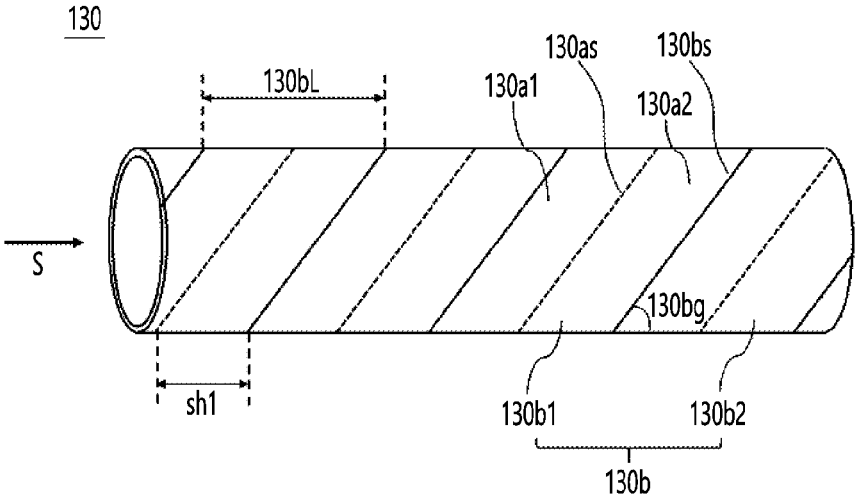

[FIG. 7]
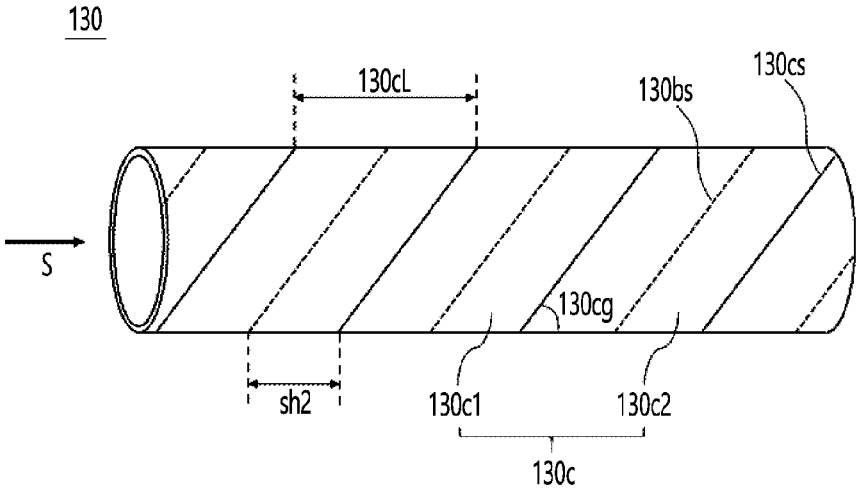
[FIG. 8]
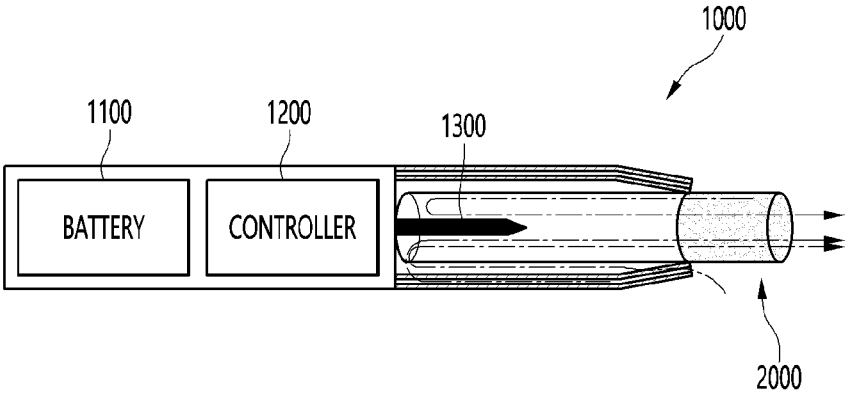

[FIG. 9]
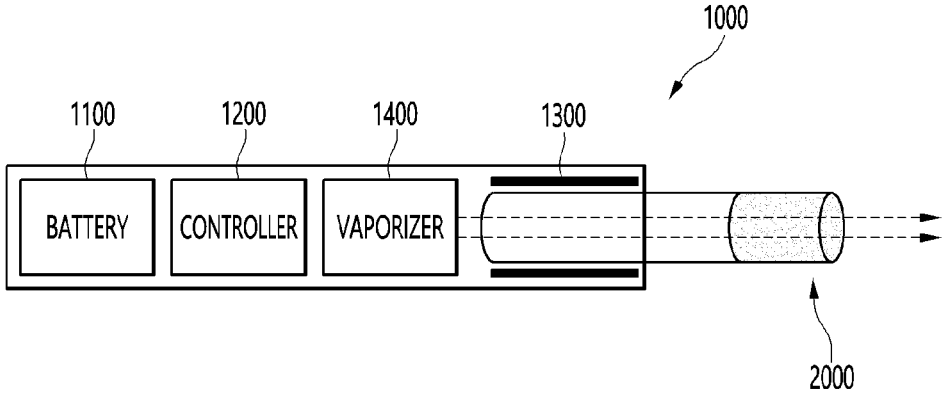
[FIG. 10]
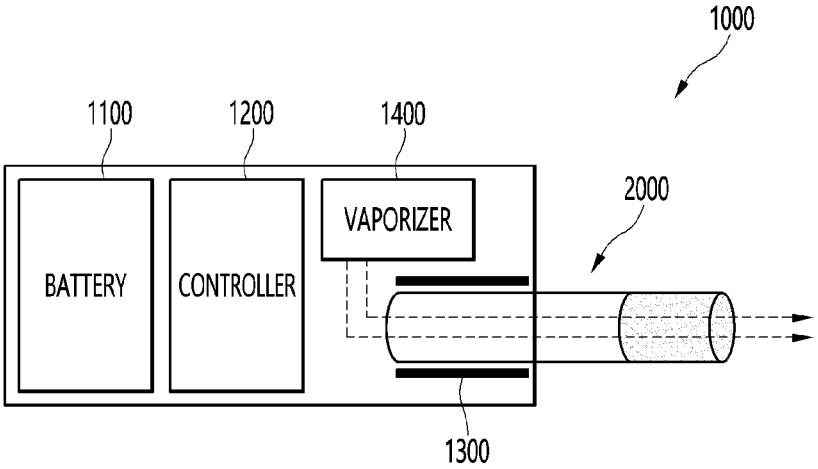

AEROSOL-GENERATING ARTICLE WITH ENHANCED VAPOR PRODUCTION

CROSS REFERENCE TO RELATED APPLICATIONS

This application is a National Stage of International Application No. PCT/KR2021/002809 filed Mar. 8, 2021, claiming priority based on Korean Patent Application No. 10-2020-0072128 filed Jun. 15, 2020.

TECHNICAL FIELD

The present disclosure relates to an aerosol-generating article with enhanced vapor production, and more particularly, to an aerosol-generating article capable of providing an improved smoking experience to a user by producing an ample amount of vapor.

BACKGROUND ART

In recent years, demand for alternative methods that overcome disadvantages of general cigarettes has increased. For example, demand for heating-type cigarettes that are inserted into electrically-operating aerosol generation devices and heated to provide a smoking experience has increased. Accordingly, active research is being carried out on heating-type cigarettes.

Vapor production is one of the factors that significantly affect satisfaction of smoking heating-type cigarettes. This is because ample vapor production may provide an improved smoking experience to a user through visual stimulation. Therefore, there is a need to develop a heating-type cigarette capable of ensuring that an ample amount of vapor is produced.

DISCLOSURE

Technical Problem

Some embodiments of the present disclosure are directed to providing an aerosol-generating article capable of providing an improved smoking experience to a user by ensuring that an ample amount of vapor is produced.

Objectives of the present disclosure are not limited to the above-mentioned objectives, and other unmentioned objectives should be clearly understood by those of ordinary skill in the art to which the present disclosure pertains from the description below.

Technical Solution

An aerosol-generating article according to some embodiments of the present disclosure includes a medium portion, a support structure which is disposed downstream of the medium portion and includes a first tubular structure having a first hollow formed therein, a cooling structure which is disposed downstream of the support structure and includes a second tubular structure which has a second hollow formed therein and is made of a cellulose acetate material, and a mouthpiece portion which is disposed downstream of the cooling structure. Here, an upstream end of the second tubular structure may abut a downstream end of the first tubular structure, and an average cross-sectional area of the second hollow may be larger than an average cross-sectional area of the first hollow.

In some embodiments, the average cross-sectional area of the second hollow may be at least 1.5 times larger than the average cross-sectional area of the first hollow.

In some embodiments, an inner diameter ratio of the first tubular structure to the second tubular structure may be in a range of 1:1.25 to 1:2.

In some embodiments, an inner diameter difference between the first tubular structure and the second tubular structure may be in a range of 1 mm to 2.5 mm.

In some embodiments, an inner diameter of the first tubular structure may be in a range of 2.0 mm to 3.0 mm, and an inner diameter of the second tubular structure may be in a range of 3.5 mm to 4.5 mm.

In some embodiments, the first tubular structure may be made of the cellulose acetate material.

In some embodiments, the second tubular structure may have a higher plasticizer content than the first tubular structure.

In some embodiments, the mouthpiece portion may consist of a cellulose acetate filter.

Advantageous Effects

According to various embodiments of the present disclosure, since a cooling structure has a larger inner diameter than a support structure, an effect of diffusing an air flow inside an aerosol-generating article can be increased. The increase in the air flow diffusion effect can increase the area and time of contact between mainstream smoke and outside air to facilitate aerosolization of the mainstream smoke. Further, by increasing the migration amount of glycerin and nicotine, vapor production and the smoking sensation can be significantly enhanced. Furthermore, due to the air flow diffusion effect, since deflection of the mainstream smoke moving toward the mouthpiece portion is reduced and the movement of air flow is facilitated, uniformity of vapor delivery can also be improved.

Also, since a tubular structure made of a cellulose acetate material is used as the cooling structure, costs can be reduced as compared to a polylactic acid (PLA) material.

In addition, since a tubular structure made of a paper material is used as the cooling structure, the cost reduction effect of the aerosol-generating article can be maximized. Further, the cooling structure made of the paper material can maximize an inner diameter difference between the cooling structure and the support structure, thereby further increasing vapor production.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is an exemplary configuration diagram schematically illustrating an aerosol-generating article according to some embodiments of the present disclosure.

FIGS. 2 and 3 are exemplary cross-sectional views schematically illustrating the aerosol-generating article according to some embodiments of the present disclosure.

FIG. 4 is an exemplary cross-sectional view schematically illustrating an aerosol-generating article according to some other embodiments of the present disclosure.

FIGS. 5 to 7 are exemplary views for describing a detailed structure of a cooling structure and a method of manufacturing the same according to some embodiments of the present disclosure.

FIGS. 8 to 10 illustrate various types of aerosol generation devices to which the aerosol-generating article according to some embodiments of the present disclosure is applicable.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various other forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the presence of or the possibility of adding one or more components, steps, operations, and/or devices other than those mentioned.

First, some terms used in various embodiments of the present disclosure will be clarified.

In the following embodiments, the term "aerosol-forming substrate" may refer to a material that is able to form an aerosol. The aerosol may include a volatile compound. The aerosol-forming substrate may be a solid or liquid. For example, solid aerosol-forming substrates may include tobacco materials based on tobacco raw materials such as reconstituted tobacco leaves, shredded tobacco (e.g., shredded tobacco leaves, shredded reconstituted tobacco leaves, or the like), and reconstituted tobacco, and liquid aerosol-forming substrates may include liquid compositions based on various combinations of nicotine, tobacco extracts, propylene glycol, vegetable glycerin, and/or various flavoring agents. However, the scope of the present disclosure is not limited to the above-listed examples. In some embodiments, "liquid" may refer to a liquid aerosol-forming substrate unless stated otherwise.

In the following embodiments, the term "aerosol-generating article" may refer to an article capable of generating an aerosol. An aerosol-generating article may include an aerosol-forming substrate. A typical example of the aerosol-generating article may be a cigarette, but the scope of the present disclosure is not limited to this example.

In the following embodiments, the term "aerosol generation device" may refer to a device that generates an aerosol using an aerosol-generating substrate in order to generate an aerosol that can be inhaled directly into the user's lungs through the user's mouth. Refer to FIGS. 8 to 10 for examples of the aerosol generation device.

In the following embodiments, the term "puff" refers to inhalation by a user, and the inhalation may refer to the user's action of drawing in smoke into his or her oral cavity, nasal cavity, or lungs through the mouth or nose.

In the following embodiments, the term "upstream" or "upstream direction" may refer to a direction moving away from an oral region of a smoker, and the term "downstream" or "downstream direction" may refer to a direction approaching the oral region of the smoker. The terms "upstream" and "downstream" may be used to describe relative positions of components constituting an aerosol-generating article. For example, in an aerosol-generating article 100 illustrated in FIG. 1, a medium portion 110 is disposed upstream or in an upstream direction of a support structure 120, and a cooling structure 130 is disposed downstream or in a downstream direction of the support structure 120.

Hereinafter, various embodiments of the present disclosure will be described in detail with reference to the accompanying drawings.

FIG. 1 is an exemplary configuration diagram schematically illustrating the aerosol-generating article 100 according to some embodiments of the present disclosure, and FIGS. 2 and 3 are exemplary cross-sectional views schematically illustrating the aerosol-generating article 100. Hereinafter, description will be given with reference to FIGS. 1 to 3.

As illustrated in FIG. 1, the aerosol-generating article 100 may include the medium portion 110, the support structure 120, the cooling structure 130, a mouthpiece portion 140, and a wrapper 150. However, this is merely a preferred embodiment for achieving the objectives of the present disclosure, and of course, some components may be added or omitted as necessary. In other words, a detailed structure of the aerosol-generating article 100 may be modified.

The aerosol-generating article 100 illustrated in FIG. 1 may have a diameter in a range of about 4 mm to 9 mm and a length in a range of about 45 mm to 50 mm, but the present disclosure is not limited thereto. For example, a length of the medium portion 110 may be in a range of about 10 mm to 14 mm (for example, 12 mm), a length of the support structure 120 may be in a range of about 8 mm to 12 mm (for example, 10 mm), a length of the cooling structure 130 may be in a range of about 12 mm to 16 mm (for example, 14 mm), and a length of the mouthpiece portion 140 may be in a range of about 10 mm to 14 mm (for example, 12 mm). However, the scope of the present disclosure is not limited to such specifications. Hereinafter, each component of the aerosol-generating article 100 will be described.

The medium portion 110 may include an aerosol-forming substrate and may generate an aerosol when heated. For example, the medium portion 110 may be inserted into an aerosol generation device 1000 illustrated in FIGS. 8 to 10 and may generate an aerosol when heated. The generated aerosol (e.g., mainstream smoke) may be inhaled by a user through the oral region of the user.

In some embodiments, the aerosol-forming substrate may include a tobacco material, but the forms into which the tobacco material is processed may vary. For example, the aerosol-forming substrate may include a reconstituted tobacco sheet such as a sheet made of reconstituted tobacco leaves. As another example, the aerosol-forming substrate may also include a plurality of tobacco strands (or shredded pieces of tobacco) formed by shredding a reconstituted tobacco sheet. For example, the medium portion 110 may be filled with a plurality of tobacco strands that are randomly arranged or arranged in the same direction (i.e., arranged in parallel). As still another example, the aerosol-forming substrate may also include shredded tobacco leaves.

In some embodiments, the aerosol-forming substrate or the medium portion 110 may include a moisturizer. The moisturizer may include glycerin, propylene glycol, or the like, but is not limited thereto.

Also, in some embodiments, the aerosol-forming substrate or the medium portion 110 may contain other additives such as a flavoring agent (that is, a flavoring material) and/or organic acid. For example, the flavoring agent may include licorice, saccharose, fructose, syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, coffee, or the like, but is not limited thereto.

Next, the support structure 120 may be disposed downstream of the medium portion 110, and an upstream portion of the support structure 120 may abut a downstream portion of the medium portion 110. The support structure 120 may serve as a support member for the medium portion 110. For example, when a heating element of a heater portion 1300 of the aerosol generation device 1000 (see FIG. 8) is inserted into the medium portion 110, the support structure 120 may serve to prevent downstream movement of the medium portion 110.

Also, the support structure 120 may serve as a passage for an aerosol (e.g., mainstream smoke) formed in the medium portion 110. More specifically, the support structure 120 may include a tubular structure having a hollow 120H formed therein, and the hollow 120H may serve as a channel for the aerosol. Also, an upstream end of the tubular structure included in the support structure 120 may abut a downstream end of a tubular structure included in the cooling structure 130. Therefore, the aerosol formed in the medium portion 110 may be moved in a direction toward the mouthpiece portion 140 (that is, the downstream direction) through the hollow 120H and a hollow 130H.

An outer diameter of the support structure 120 may be in a range of about 3 mm to 10 mm (for example, 7 mm). An appropriate value within a range of about 2 mm to 4.5 mm may be employed as an inner diameter of the support structure 120 (that is, a diameter of the hollow 120H), but the present disclosure is not limited thereto. Preferably, the inner diameter of the support structure 120 (that is, the diameter of the hollow 120H) may be about 2.5 mm, about 3.4 mm, about 4.2 mm, or the like, but is not limited thereto. In some embodiments, in order to maximize the inner diameter difference between the cooling structure 130 and the support structure 120, the inner diameter of the support structure 120 may be defined to have a relatively small value within a designated range (e.g., the range of about 2 mm to 4.5 mm). For example, the inner diameter of the support structure 120 may have a value within a range of about 2 mm to 3 mm. This will be described again below with reference to the cooling structure 130.

In some embodiments, the support structure 120 may include a tubular structure made of a cellulose acetate material. For example, the support structure 120 may be a tube filter made of cellulose acetate fibers. The support structure 120 may effectively prevent downstream movement of the medium portion 110 when a heating element is inserted, and may also provide filtering and cooling effects for the aerosol.

Also, in some embodiments, the support structure 120 may be a flavoring filter to which a flavoring material such as menthol is added (that is, a flavoring filter which is flavored). For example, a flavoring liquid including about 60 to 80 wt % menthol and about 20 to 40 wt % propylene glycol may be added to the flavoring filter. Here, the amount of added flavoring liquid may be in a range of about 1 mg to 10 mg (preferably, 1 mg to 7 mg), but is not limited thereto. According to the embodiment, the flavor expressing property of the aerosol-generating article 100 may be enhanced.

In some other embodiments, the support structure 120 may also be a filter to which a moisturizing material such as glycerin and/or propylene glycol is added (that is, a filter which is moisturized). In such a case, vapor production of the aerosol-generating article 100 may be enhanced.

Meanwhile, preferably, the support structure 120 may be manufactured to have appropriate hardness (or durability) to serve as a support. In some embodiments, during manufacture of the support structure 120, an amount of added plasticizer may be adjusted to adjust the hardness of the support structure 120. Also, the plasticizer content may be increased in proportion to the inner diameter of the support structure 120 (that is, in inverse proportion to the thickness of the support structure 120). In some other embodiments, the support structure 120 may also be manufactured by inserting structures such as films or tubes formed of the same or different materials thereinto (that is, into the hollow 120H).

Next, the cooling structure 130 may serve to cool a high-temperature aerosol which is generated as the medium portion 110 is heated. Specifically, the cooling structure 130 may include a tubular structure having the hollow 130H formed therein and may cool the aerosol passing through the hollow 130H. Accordingly, the user may inhale the aerosol at a proper temperature, and aerosolization of the mainstream smoke is facilitated such that vapor production is enhanced.

In some embodiments, the cooling structure 130 may cool the mainstream smoke so that the temperature of the mainstream smoke discharged through the mouthpiece portion 140 is in a range of about 45° C. to 60° C. Preferably, the temperature of the mainstream smoke may be in a range of about 48° C. to 58° C. or in a range of about 51° C. to 56° C. (refer to Experimental Example 2 or the like). Within such temperature ranges, the smoking sensation felt by the user may be significantly enhanced.

The cooling structure 130 may only include the tubular structure or further include an additional structure other than the tubular structure. Hereinafter, for convenience of understanding, description will be continued assuming that the cooling structure 130 only includes the tubular structure. However, the scope of the present disclosure is not limited to this example.

The materials forming the tubular structure of the cooling structure 130 may vary, and according to the types of materials, specifications (e.g., length, thickness, inner diameter, and the like) of the cooling structure 130 may vary.

In a first embodiment, the tubular structure of the cooling structure 130 may be made of a cellulose acetate material. For example, the cooling structure 130 may be a tube filter made of cellulose acetate fibers. Hereinafter, specific embodiments relating to the first embodiment will be described.

In some embodiments, an average cross-sectional area of the hollow 130H may be larger than an average cross-sectional area of the hollow 120H, for example, about 1.5 times larger or more. Preferably, the average cross-sectional area of the hollow 130H may be about 2 times or 2.5 times larger or more or may be, more preferably, about 3 times larger or more. In this case, the mainstream smoke (i.e., air flow) moving from the hollow 120H of the support structure 120 to the hollow 130H of the cooling structure 130 may be rapidly diffused (see FIG. 3). As directionality of the diffused mainstream smoke in the downstream direction is weakened, the area and time of contact between the mainstream smoke and outside air, which enters through perforations 160, may be increased. As a result, the effect of cooling the mainstream smoke may be improved, and aerosol formation is facilitated such that vapor production is enhanced.

Also, in some embodiments, an inner diameter ratio of the support structure 120 to the cooling structure 130 may be in a range of about 1:1.25 to 1:3. Preferably, the inner diameter ratio may be in a range of about 1:1.25 to 1:2.5 or 1:1.5 to 1:2. As a specific example, in a case in which the inner diameter of the support structure 120 is in a range of about 2.0 mm to 3.0 mm, the inner diameter of the cooling structure 130 may be in a range of about 3.5 mm to 5.0 mm. Alternatively, in a case in which the inner diameter of the support structure 120 is about 2.5 mm, the inner diameter of the cooling structure 130 may be in a range of about 3.5 mm to 4.8 mm, or preferably in a range of about 4.0 mm to 4.4 mm (refer to Experimental Example 1 or the like). Within such numerical ranges, the aerosol cooling effect and vapor production may be enhanced, and appropriate durability may also be secured.

Also, in some embodiments, the inner diameter difference between the cooling structure 130 and the support structure 120 (that is, the inner diameter difference between the tubular structures thereof) may be in a range of about 1 mm to 2.5 mm. Preferably, the inner diameter difference may be in a range of about 1.5 mm to 2.1 mm or about 1.6 mm to 2.2 mm. Within such numerical ranges, the aerosol cooling effect and vapor production may be enhanced, and appropriate durability may also be secured. For example, in a case in which the inner diameter difference is too small, the air flow diffusion effect may be decreased causing aerosol cooling performance to decrease (refer to Experimental Examples 1 and 2, etc.). Conversely, in a case in which the inner diameter difference is too large, the thickness of the cooling structure 130 may be too small causing durability to decrease (of course, the air flow diffusion effect is enhanced).

As mentioned above, in a case in which the inner diameter difference between the cooling structure 130 and the support structure 120 is maximized, the durability (or stability) of the cooling structure 130 may be a problem, but the problem may be addressed by adjusting the plasticizer content, the structure of the hollow, the length of the cooling structure 130, and the like. Hereinafter, embodiments relating thereto will be described.

In some embodiments, both the first tubular structure of the support structure 120 and the second tubular structure of the cooling structure 130 may be made of a cellulose acetate material, and the plasticizer content (or the amount of added plasticizer) of the second tubular structure may be larger than that of the first tubular structure. For example, during manufacture of the first tubular structure, the plasticizer in the amount of a general reference value (e.g., about 20 wt % of the material) may be added, and during manufacture of the second tubular structure, a larger amount of plasticizer may be added. In this case, the hardness of the second tubular structure may be increased, and thus the durability of the cooling structure 130 may be supplemented even when the thickness thereof is thin.

In the embodiment described above, the plasticizer content ratio of the first tubular structure to the second tubular structure may be in a range of about 1:1.2 to 1:2. Preferably, the plasticizer content ratio may be in a range of about 1:1.2 to 1:1.8 or 1:1.3 to 1:1.7. For example, the plasticizer content in the first tubular structure may be about 20 wt % of the cellulose acetate material, and the plasticizer content in the second tubular structure may be about 30 wt % of the cellulose acetate material. Within such numerical ranges, the durability of the cooling structure 130 may be supplemented, and simultaneously, excessive hardening of the cooling structure 130 may be prevented.

In some embodiments, the structure of the hollow 130H of the second tubular structure may be modified. For example, as illustrated in FIG. 4, instead of having a uniform diameter (or cross-sectional area), the hollow 130H may be designed such that a diameter D2A (or cross-sectional area) of a first portion is smaller than a diameter D2B (or cross-sectional area) of a second portion. For example, as illustrated in FIG. 4, an upstream end portion of the hollow 130H may have a tapered structure. In this case, the air flow diffusion effect may be guaranteed, and simultaneously, the durability of the cooling structure 130 may also be supplemented.

In some embodiments, the length of the cooling structure 130 may be adjusted on the basis of an inner diameter D2 of the second tubular structure (that is, the cooling structure 130). For example, the cooling structure 130 may be manufactured in a shorter length as the inner diameter thereof is increased. For example, the cooling structure 130 may be manufactured such that the length thereof is at most about 3.5 times larger than the inner diameter D2. Preferably, the length of the cooling structure 130 may be at most about 3.4 times or 3.3 times larger than the inner diameter D2. As such, the durability of the cooling structure 130 may be supplemented.

So far, the case in which the tubular structure of the cooling structure 130 is made of the cellulose acetate material has been described. Hereinafter, a case in which the tubular structure is made of a different material will be described.

In a second embodiment, the tubular structure of the cooling structure 130 may be made of a paper material. For example, the cooling structure 130 may be a paper tube filter. Since the inner diameter D2 may be easily maximized in a tubular structure made of a paper material, the inner diameter difference (or the difference in the cross-sectional area of the hollow) between the cooling structure 130 and the support structure 120 may also be easily maximized. This may further enhance the air flow diffusion effect, and ultimately, vapor production of the aerosol-generating article 100 may be further enhanced. Further, by lowering the temperature of the mainstream smoke, the smoking sensation felt by the user may also be enhanced. Further, the tubular structure made of a paper material (e.g., paper tube filter) may significantly increase the migration amount of glycerin due to a relatively low removal capacity, thereby enhancing vapor production.

In a case in which the tubular structure made of a paper material is used, the inner diameter difference, cross-sectional area difference, and the like between the support structure 120 and the cooling structure 130 may vary as in the following embodiments.

In some embodiments, the average cross-sectional area of the hollow 130H may be larger than the average cross-sectional area of the hollow 120H, for example, about 1.5 times larger or more. Preferably, the average cross-sectional area of the hollow 130H may be about 2 times or 3 times larger or more or may be, more preferably, about 4 times, 5 times, or 6 times larger or more. In this case, the mainstream smoke (i.e., air flow) moving from the hollow 120H of the support structure 120 to the hollow 130H of the cooling structure 130 may be more rapidly diffused (see FIG. 3), and for the same reasons as described above, the mainstream smoke cooling effect and vapor production may be further enhanced.

Also, in some embodiments, the inner diameter ratio of the support structure 120 to the cooling structure 130 may be in a range of about 1:1 to 1:3.5. Preferably, the inner diameter ratio may be in a range of about 1:1.5 to 1:3.5 or 1:1.5 to 1:3. As a specific example, in a case in which the inner diameter of the support structure 120 is 2.5 mm, the inner diameter of the cooling structure 130 may be in a range of 3.75 mm to 7.5 mm, preferably in a range of 5 mm to 7.5 mm, and more preferably in a range of 6 mm to 7 mm (refer to Experimental Example 1 or the like). Within such numerical ranges, the aerosol cooling effect and vapor production may be significantly enhanced. Here, when a paper tube in which the inner diameter D2 is equal to about 90% to 95% of the outer diameter is applied as the cooling structure 130, the difference between an inner diameter D1 of the support structure 120 and the inner diameter D2 of the cooling structure 130 may be maximized, and accordingly, the mainstream smoke diffusion effect and the resulting mainstream smoke cooling effect may also be further maximized.

Also, in some embodiments, the inner diameter difference between the cooling structure 130 and the support structure 120 (that is, the inner diameter difference between the tubular structures thereof) may be about 1.25 mm or more, preferably, about 2.5 mm or more or about 3.5 mm or more. More preferably, the inner diameter difference may be about 4.5 mm or more. Within such numerical ranges, the aerosol cooling effect and vapor production may be significantly enhanced.

Meanwhile, when the cooling structure 130 is designed only in consideration of cooling effect maximization, appropriate rigidity may not be secured and thus difficulty may occur in manufacturing and assembling the cooling structure 130, and durability of the aerosol-generating article 100 may be degraded. Accordingly, the cooling structure 130 according to some embodiments may have the specifications shown in Table 1 below in order to simultaneously maximize the cooling effect and secure workability in manufacturing the cooling structure 130 and durability of the aerosol-generating article 100.

TABLE 1

| | |
|---|---|
| Classification | 13.7 mm. 7 pieces |
| Weight (mg) | 90-110 (e.g., 103.5) |
| Length (mm) | 12-16 (e.g., 14) |
| Thickness (mm) | 0.4-0.6 (e.g., 0.52) |
| Outer side circumference (mm) | 20-23 (e.g., 21.85) |
| Outer diameter (mm) | 6.5-7.5 (e.g., 6.96) |
| Inner diameter (mm) | 5.3-7.0 (e.g., 6.0) |
| Inner side circumference (mm) | 19-22 (e.g., 20.23) |
| Total surface area ($mm^2$) | 560-630 (e.g., 611) |
| Specific surface area (mm2/mg) | 5-7 (e.g., 5.90) |
| Basis weight (gsm) | 150-190 (e.g., 169.4) |
| Roundness (%) | 95-99 |

For example, the basis weight of the paper material constituting the cooling structure 130 may be in a range of 150 gsm to 190 gsm. Within such a basis weight range, the rigidity and durability of the cooling structure 130 may be secured, and workability in manufacturing the cooling structure 130 may also be improved. Specifically, in a case in which the basis weight is less than 150 gsm, it is difficult to secure appropriate rigidity for the cooling structure 130, and in a case in which the basis weight is larger than 190 gsm, a knife for cutting the tubular structure may be damaged or cutting may not be smoothly performed and thus workability may be degraded.

For efficient aerosol cooling, the cooling structure 130 may have a structure in which outside air enters the cooling structure 130. However, a detailed structure thereof may vary according to embodiments.

In some embodiments, as illustrated, in order to allow the inside and outside of the tubular structure (or the cooling structure 130) to be in fluid communication with each other, a plurality of perforations 160 may be formed through the tubular structure (or the cooling structure 130) and the wrapper 150. For example, the plurality of perforations 160 may be formed to penetrate the wrapper 150 by an on-line perforation method. In this case, outside air entering through the perforations 160 may dilute the mainstream smoke and be moved to the mouthpiece portion 140 (see FIG. 3). In the embodiment, the tubular structure may be made of a paper material which is nonporous or has a low porosity. For example, the bulk of the paper material may be about 2.0 $cm^3/g$ or less. Preferably, the bulk of the paper material may be about 1.5 $cm^3/g$ or less or about 1.0 $cm^3/g$ or less and, more preferably, 0.8 $cm^3/g$ or less, but is not limited thereto. Here, the bulk refers to a value obtained by dividing the thickness by the basis weight. A low-bulk paper material may have low porosity because a pore structure thereof is generally not developed.

In some other embodiments, a plurality of perforations (e.g., the perforations 160) may be formed only in the wrapper 150, and the tubular structure may be made of a porous paper material. For example, the plurality of perforations may be formed only in the wrapper 150 using an off-line perforation method. In this case, outside air may enter the tubular structure through the plurality of perforations and the porous paper material.

In still some other embodiments, a plurality of perforations (e.g., the perforations 160) may be formed in the tubular structure, and the wrapper 150 may be a porous wrapper. In this case, outside air may enter the tubular structure through the porous wrapper and the plurality of perforations. The tubular structure may be made of porous paper or nonporous paper.

Meanwhile, in some embodiments, the hollow tubular structure made of a paper material may be manufactured in a form in which a plurality of spiral pieces of paper are stacked. Using this manufacturing method, the rigidity and durability of the structure may be improved, and airtightness may be improved. Hereinafter, the embodiment will be described in detail with reference to FIGS. 5 to 7.

FIGS. 5 to 7 are exemplary views for describing a detailed structure of the cooling structure 130 and a method of manufacturing the same according to some embodiments of the present disclosure. In order to provide convenience of understanding, the detailed structure of the cooling structure 130 has been simplified and exaggerated in FIGS. 5 to 7. For example, in order to clearly describe the positional relationship or the like of spiral layers 130*a*, 130*b*, and 130*c*, the axial length of the cooling structure 130 is relatively longer, the diameter of the cooling structure 130 is relatively shorter, and only the tubular structure excluding the perforations 160 is illustrated. Therefore, the scope of the present disclosure is not limited by the structure of the cooling structure 130 illustrated in FIGS. 5 to 7.

As illustrated in FIGS. 5 to 7, the tubular structure of the cooling structure 130 may have a structure in which an inner paper spiral layer 130*a*, an intermediate paper spiral layer 130*b*, and an outer paper spiral layer 130*c* are sequentially stacked. The inner paper and intermediate paper, and the intermediate paper and outer paper may be attached to each other using an adhesive. The adhesive may be ethylene vinyl acetate (EVA) having a solid content of 43 wt % to 46 wt %, a viscosity in a range of 14,000 cps to 16,000 cps, and a pH in a range of 3 to 6. The adhesive may effectively prevent the deformation of the shape of the cooling structure 130 when a rod on which the spiral layers longitudinally extend is cut into individual cooling structures 130 having a roundness in a range of about 95% to 99%. Further, the adhesive may improve the airtightness of the cooling structure 130 and also prevent leakage of the flavoring material to the outside of the cooling structure 130. Furthermore, since appropriate rigidity may be imparted to the cooling structure 130 even when the inner diameter of the cooling structure 130 is increased, the cooling performance of the cooling structure 130 may also be effectively improved.

Hereinafter, each of the spiral layers 130*a*, 130*b*, and 130*c* will be described in more detail with reference to the drawings thereof.

As illustrated in FIG. 5, the innermost layer of the tubular structure of the cooling structure 130 may be the inner paper spiral layer 130*a* which is formed of the inner paper.

A width 130*a*L of the inner paper constituting the inner paper spiral layer 130*a* in an axial direction S of the cooling structure 130 may be in a range of about 15 mm to 25 mm (for example, about 20 mm) but is not limited thereto.

A downstream end of a first inner paper surface 130*a*1 and an upstream end of a second inner paper surface 130*a*2 adjacent to the first inner paper surface 130*a*1, which constitute the inner paper spiral layer 130*a*, may be substantially parallel to and come in contact with each other and form a tangent line 130*as*. An angle 130*ag* formed between the tangent line 130*as* and the axial direction S of the cooling structure 130 may be in a range of about 40° to 55° but is not limited thereto.

Meanwhile, in consideration of the flatness of the intermediate paper spiral layer 130*b* and the outer paper spiral layer 130*c* that will be stacked on the inner paper spiral layer 130*a* later and in consideration of the airtightness of the tubular structure, adjacent inner paper surfaces constituting the inner paper spiral layer 130*a* (for example, the downstream end of the first inner paper surface 130*a*1 and the upstream end of the second inner paper surface 130*a*2) may come in contact with each other without overlapping or may be spaced apart from each other by a distance that is greater than 0 mm and less than or equal to 1 mm.

In some embodiments, in order to form a framework of a uniform spiral structure, the inner paper may have a basis weight in a range of 50 gsm to 70 gsm and a thickness in a range of 0.05 mm to 0.10 mm.

Next, as illustrated in FIG. 6, the intermediate paper spiral layer 130*b* may be stacked on the inner paper spiral layer 130*a* of the cooling structure 130. In FIG. 6, the tangent line 130*as* of the inner paper spiral layer 130*a* is illustrated as a dotted line, and a tangent line 130*bs* of the intermediate paper spiral layer 130*b* is illustrated as a solid line.

A width 130*b*L of the intermediate paper constituting the intermediate paper spiral layer 130*b* in the axial direction S of the cooling structure 130 may be in a range of about 15 mm to 25 mm (for example, about 20 mm) but is not limited thereto.

A downstream end of a first intermediate paper surface 130*b*1 and an upstream end of a second intermediate paper surface 130*b*2 adjacent to the first intermediate paper surface 130*b*1, which constitute the intermediate paper spiral layer 130*b*, may be substantially parallel to and come in contact with each other and form the tangent line 130*bs*. An angle 130*bg* formed between the tangent line 130*bs* and the axial direction S of the cooling structure 130 may be in a range of about 40° to 55° but is not limited thereto.

Also for the intermediate paper spiral layer 130*b*, in consideration of the flatness of the outer paper spiral layer 130*c* that will be stacked on the intermediate paper spiral layer 130*b* and in consideration of the airtightness of the tubular structure, adjacent intermediate paper surfaces constituting the intermediate paper spiral layer 130*b* (for example, the downstream end of the first intermediate paper surface 130*b*1 and the upstream end of the second intermediate paper surface 130*b*2) may come in contact with each other without overlapping or may be spaced apart from each other by a distance that is greater than 0 mm and less than or equal to 1 mm. The tangent line 130*bs* of the intermediate paper spiral layer 130*b* may be shifted by 7 mm to 13 mm from the tangent line 130*as* of the inner paper spiral layer 130*a* in the axial direction of the aerosol-generating article. That is, the downstream end of the first intermediate paper surface 130*b*1 may be shifted by 7 mm to 13 mm from the downstream end of the first inner paper surface 130*a*1 in the axial direction of the aerosol-generating article.

In some embodiments, in order to ensure the rigidity and airtightness of the cooling structure, the intermediate paper may have a basis weight in a range of 120 gsm to 160 gsm and a thickness in a range of 0.15 mm to 0.20 mm.

Next, as illustrated in FIG. 7, the outer paper spiral layer 130*c* may be stacked on the intermediate paper spiral layer 130*b* of the cooling structure 130. In FIG. 7, the tangent line 130*bs* of the intermediate paper spiral layer 130*b* is illustrated as a dotted line, and a tangent line 130*cs* of the outer paper spiral layer 130*c* is illustrated as a solid line.

A width 130*c*L of the outer paper constituting the outer paper spiral layer 130*c* in the axial direction S of the cooling structure 130 may be in a range of about 15 mm to 25 mm (for example, about 20 mm) but is not limited thereto.

A downstream end of a first outer paper surface 130*c*1 and an upstream end of a second outer paper surface 130*c*2 adjacent to the first outer paper surface 130*c*1, which constitute the outer paper spiral layer 130*c*, may be substantially parallel to and come in contact with each other and form the tangent line 130*cs*. An angle 130*cg* formed between the tangent line 130*cs* and the axial direction S of the cooling structure 130 may be in a range of about 40° to 55° but is not limited thereto.

For the outer paper spiral layer 130*c*, in consideration of surface flatness and problems such as external contamination of the paper tube (that is, the tubular structure) and spiral layer deviation therefrom which may occur in a cigarette manufacturing process, adjacent outer paper surfaces constituting the outer paper spiral layer 130*c* (for example, the downstream end of the first outer paper surface 130*c*1 and the upstream end of the second outer paper surface 130*c*2) may come in contact with each other without overlapping or may overlap each other by more than 0 mm and less than or equal to 1 mm. The tangent line 130*cs* of the outer paper spiral layer 130*c* may be shifted by 7 mm to 13 mm from the tangent line 130*bs* of the intermediate paper spiral layer 130*b* in the axial direction S of the aerosol-generating article. That is, the downstream end of the first outer paper surface 130*c*1 may be shifted by 7 mm to 13 mm from the downstream end of the first intermediate paper surface 130*b*1 in the axial direction S of the aerosol-generating article.

In some embodiments, since the intermediate paper spiral layer 130*b* is shifted from the inner paper spiral layer 130*a* and the outer paper spiral layer 130*c* is shifted from the intermediate paper spiral layer 130*b*, the outer paper spiral layer 130*c* may have a spiral structure that substantially overlaps the inner paper spiral layer 130*a*. That is, the outer paper spiral layer 130*c* may not be shifted from the inner paper spiral layer 130*a*.

In some embodiments, in order to ensure the rigidity and airtightness of the cooling structure, the outer paper may have a basis weight in a range of 120 gsm to 160 gsm and a thickness in a range of 0.15 mm to 0.20 mm.

Also, in some embodiments, the angles 130*ag*, 130*bg*, and 130*cg* formed between the paper surfaces 130*a*1, 130*b*1, and 130*c*1 and the axial direction S may be different from each other. In this case, since the leakage of gas between the paper surfaces 130*a*1, 130*b*1, and 130*c*1 may be more effectively prevented, the airtightness of the cooling structure 130 may be further improved.

Also, in some embodiments, the spiral structures of the spiral layers 130*a*, 130*b*, and 130*c* may not overlap each other. In this case, since the leakage of gas between the paper surfaces 130*a*1, 130*b*1, and 130*c*1 may be more effectively prevented, the airtightness of the cooling structure 130 may be further improved.

In short, since the tubular structure of the cooling structure 130 is formed to have a combined structure in which a plurality of paper layers are stacked as described above, the rigidity and airtightness of the cooling structure 130 that are required for a subsequent process may be effectively secured. Further, external contamination of the tubular structure and spiral layer deviation therefrom may be prevented, and the uniformity and flatness of the tubular structure may also be easily secured.

The detailed structure of the cooling structure 130 made of a paper material according to some embodiments of the present disclosure has been described above with reference to FIGS. 5 to 7.

As mentioned above, the plurality of perforations 160 may be formed in the cooling structure 130. The plurality of perforations 160 may serve to lower the surface temperature of the mouthpiece and the temperature of the mainstream smoke delivered to the smoker during smoking. Here, the air dilution rate of the cooling structure 130 (or the aerosol-generating article 100) may be determined according to the formation conditions (e.g., perforation method, number and size, etc.) of the plurality of perforations 160. As the air dilution rate is higher (for example, the number of perforations is larger), the temperature of the mainstream smoke may be further lowered, but vapor production may be reduced and false puffs may occur. Thus, the air dilution rate should be appropriately adjusted according to the structure and inherent characteristics of the aerosol-generating article 100 (refer to Experimental Example 3 or the like). Here, the air dilution rate may refer to a ratio of the volume of outside air entering the final mainstream smoke through the cooling structure 130 to the total volume of the final mainstream smoke.

In some embodiments, the plurality of perforations 160 may be formed so that the air dilution rate of the cooling structure 130 is in a range of about 5% to 40%, preferably in a range of about 10% to 30% or 15% to 35%, and more preferably in a range of 15% to 25%. Within such numerical ranges, the mainstream smoke temperature may be significantly lowered, and the vapor production reduction problem may be prevented (refer to Experimental Example 3 or the like). For reference, a non-perforated cooling structure 130 manufactured to have a structure in which a plurality of paper layers are stacked in a spiral shape as described above may have an air dilution rate of substantially 0%.

In some embodiments, the plurality of perforations 160 may be formed at a position spaced 5 mm to 10 mm (preferably, 7 mm to 9 mm) apart (L1) from the downstream end of the cooling structure 130 in the upstream direction and may be formed at a position spaced 15 mm to 25 mm (preferably, 18 mm to 22 mm) apart (L2) from the downstream end of the aerosol-generating article 100 in the upstream direction. Since the plurality of perforations 160 are formed at the positions described above, a case in which the aerosol generation device 1000 (see FIGS. 8 to 10) interferes with the perforations or a case in which the smoker's mouth or the like interferes with the perforations during smoking may be addressed. Further, an air flow in the hollow 130H of the cooling structure 130 may be facilitated during smoking, and thus non-uniform melting of the cellulose acetate filter of the mouthpiece portion 140 may also be alleviated.

In some embodiments, the plurality of perforations 160 may include six or more perforations arranged along one row or two rows in the circumferential direction of the cooling structure 130. For example, the plurality of perforations 160 may include ten holes arranged in one row, but of course, the scope of the present disclosure is not limited thereto.

The cooling structure 130 constituting the aerosol-generating article 100 has been described above. Hereinafter, other components of the aerosol-generating article 100 will be described.

The mouthpiece portion 140 may serve as a mouthpiece which comes in contact with the oral region of the user and serve as a filter which finally delivers an aerosol delivered from the upstream to the user. The mouthpiece portion 140 may be disposed downstream of the cooling structure 130, may have an upstream portion which abuts a downstream portion of the cooling structure 130, and may form the downstream end of the aerosol-generating article 100.

In some embodiments, the mouthpiece portion 140 may be manufactured as a cellulose acetate filter. That is, the mouthpiece portion 140 may be manufactured using a cellulose acetate fiber (i.e., tow) as a filter material. Although not illustrated, the mouthpiece portion 140 may also be manufactured as a recessed filter.

In some other embodiments, the mouthpiece portion 140 may be manufactured using a cellulose material having a bulk of a reference value or more as a filter material. The cellulose material may be, for example, paper, but the scope of the present disclosure is not limited thereto. As mentioned above, the bulk refers to a value obtained by dividing the thickness by the basis weight, and a high-bulk cellulose material may accommodate a large amount of liquid due to including numerous pores therein.

For example, a large amount of liquid moisturizing material may be added to the cellulose material. The liquid moisturizing material may include glycerin or propylene glycol, but is not limited thereto. In this case, the migration amount of glycerin may be increased and vapor production may be further enhanced during smoking.

As another example, a large amount of flavoring liquid may be added to the cellulose material. The flavoring liquid is obtained by adding a flavoring material to a solvent. The flavoring material may include any material that expresses flavor, such as menthol. In this case, the flavor expressing property of the aerosol-generating article 100 may be significantly improved during smoking. Further, since the high-bulk cellulose material may suppress the rapid volatilization of a volatile material (e.g., a flavoring material) through its complex pore structure, the flavor persistence of the aerosol-generating article 100 may also be improved.

In the above-described examples, a bulk value of the cellulose material may be changed on the basis of target porosity (or target flavoring liquid accommodation amount) of the cellulose material, but may be, preferably, about 1 $cm^3/g$ or more. More preferably, the bulk of the cellulose material may be about 1.5 $cm^3/g$, 2 $cm^3/g$, or 2.5 $cm^3/g$ or more. Within such numerical ranges, the liquid accommodation amount of the cellulose material may be significantly increased.

Also, the flavoring material added to the cellulose material may be a material (e.g., L-menthol) which is present as a crystalline solid at room temperature (e.g., 20±5° C.). In this case, a content ratio between a solvent and the flavoring material may be important. This is because, in a case in which the content of solvent is low, the flavoring material may be precipitated in a solid phase in the cellulose material and thus the resistance to draw, hardness, and the like of the mouthpiece portion 140 may be rapidly increased. In the embodiment, the content of flavoring material may be, preferably, about 60 wt % or less. More preferably, the content may be about 50 wt % or 40 wt % or less. It was confirmed that, within such numerical ranges, a change in the physical properties of the mouthpiece portion 140 is minimized.

Also, in a case in which the flavoring material is added in the form of a flavoring liquid, the solvent may include propylene glycol or a medium chain fatty acid triglyceride (hereinafter abbreviated as "MCTG"). However, the scope of the present disclosure is not limited to this example. Propylene glycol is a polar (or hydrophilic) solvent and thus may be effective when the flavoring material is polar (or hydrophilic), and MCTG is a nonpolar (or hydrophobic) solvent and thus may be effective when the flavoring material is nonpolar (or hydrophobic). This is because nonpolar MCTG can dissolve the nonpolar flavoring material well and can also suppress the volatilization of the volatile flavoring material well. For example, in a case in which the flavoring material is menthol, MCTG may be effective as a solvent. In this case, MCTG may suppress the volatilization of menthol and prevent a rapid decrease in a menthol flavor expression strength during smoking. That is, it is possible to significantly alleviate a problem in which the menthol flavor is overexpressed at an early stage of smoking and not expressed well at middle and later stages of smoking.

Also, the amount of added flavoring liquid (or liquid moisturizing material) may vary according to the content (or area) of the cellulose material in the mouthpiece portion 140 but may be, preferably, in a range of about 1.0 mg/mm to 9.0 mg/mm. More preferably, the amount of added flavoring liquid may be in a range of about 2.0 mg/mm to 7.0 mg/mm, 3.0 mg/mm to 7.0 mg/mm, 3.0 mg/mm to 6.0 mg/mm, or 2.0 mg/mm to 6.0 mg/mm. Within such numerical ranges, the flavor expressing property may be increased, a problem in which the wrapper becomes wet may be minimized, and a problem in which an excessively strong flavor is expressed during smoking causing the smoker to feel aversion may be prevented.

For reference, all of the support structure 120, the cooling structure 130, and the mouthpiece portion 140 may serve as a filter for an aerosol. To emphasize their function as a filter, each component may be referred to as "filter segment." For example, the support structure 120, the cooling structure 130, and the mouthpiece portion 140 may be referred to as a first filter segment, a second filter segment, and a third filter segment, respectively.

Next, the wrapper 150 may be porous wrapping paper or nonporous wrapping paper. For example, the wrapper 150 may have a thickness in a range of about 40 μm to 80 μm and a porosity in a range of about 5 CU to 50 CU, but the scope of the present disclosure is not limited thereto.

Although not illustrated, at least one of the medium portion 110, the support structure 120, the cooling structure 130, and the mouthpiece portion 140 may be wrapped with a separate wrapper before being wrapped by the wrapper 150. For example, the medium portion 110 may be wrapped by a medium portion wrapper (not illustrated), and the support structure 120, the cooling structure 130, and the mouthpiece portion 140 may be wrapped by a first filter wrapper (not illustrated), a second filter wrapper (not illustrated), and a third filter wrapper (not illustrated), respectively. However, a method of wrapping the aerosol-generating article 100 and the components thereof may also vary.

In some embodiments, the wrappers may have different physical properties according to the corresponding regions of the aerosol-generating article 100. For example, the medium portion wrapper surrounding the medium portion 110 may have a thickness of about 61 μm and a porosity of about 15 CU, and the first filter wrapper surrounding the support structure 120 may have a thickness of about 63 μm and a porosity of about 15 CU, but the present disclosure is not limited thereto. Also, an aluminum foil may be further included on an inner side surface of the medium portion wrapper and/or the first filter wrapper. Also, the second filter wrapper surrounding the cooling structure 130 and the third filter wrapper surrounding the mouthpiece portion 140 may be manufactured using hard wrapping paper. For example, the second filter wrapper may have a thickness of about 158 μm and a porosity of about 33 CU, and the third filter wrapper may have a thickness of about 155 μm and a porosity of about 46 CU, but the present disclosure is not limited thereto.

In some embodiments, a predetermined material may be added into the wrapper 150. Here, an example of the predetermined material may include silicone, but is not limited thereto. Silicone has characteristics such as heat resistance, oxidation resistance, resistance to various chemicals, water repellency, an electrical insulating property, and the like. However, the wrapper 150 may be coated with any material other than silicone as long as the material has the above-described characteristics.

Meanwhile, in some embodiments, the aerosol-generating article 100 may further include a front end filter segment (not illustrated) which is disposed upstream of the medium portion 110 and abuts the medium portion 110. The front end filter segment may prevent the medium portion 110 from falling out of the aerosol-generating article 100 and may also prevent a liquefied aerosol from flowing from the medium portion 110 into the aerosol generation device 1000 (see FIGS. 8 to 10) during smoking. Also, the front end filter segment may include an aerosol channel, and the aerosol channel may allow the aerosol to easily move toward the mouthpiece portion 140 through the front end filter segment. The aerosol channel may be disposed at the center of the front end filter segment. For example, the center of the aerosol channel may coincide with the center of the front end filter segment. The aerosol channel may have various cross-sectional shapes such as a circular shape and a trilobate shape. In some embodiments, the front end filter segment may be manufactured using a cellulose acetate material.

The aerosol-generating article 100 according to some embodiments of the present disclosure has been described above with reference to FIGS. 1 to 7. According to the above description, by maximizing the inner diameter difference (or the difference in the average cross-sectional area of the hollow) between the support structure 120 and the cooling structure 130, cooling performance may be improved and the aerosolization of the mainstream smoke may be facilitated. Further, the migration amount of glycerin may be increased, and thus vapor production during smoking may be significantly enhanced.

Hereinafter, various types of aerosol generation devices 1000 to which the aerosol-generating article 100 described above is applicable will be briefly described with reference to FIGS. 8 to 10.

FIG. 8 is an exemplary configuration diagram illustrating a cigarette-type aerosol generation device 1000, and FIGS. 9 and 10 are exemplary configuration diagrams illustrating hybrid-type aerosol generation devices 1000 in which a liquid and a cigarette are used together. Hereinafter, the aerosol generation devices 1000 will be briefly described.

As illustrated in FIG. 8, the aerosol generation device 1000 may be a device that generates an aerosol through a cigarette 2000 inserted into a space therein. Here, the cigarette 2000 may correspond to the aerosol-generating article 100 described above. More specifically, when the cigarette 2000 is inserted into the aerosol generation device 1000, the aerosol generation device 1000 may operate a heater portion 1300 to generate an aerosol from the cigarette 2000. The generated aerosol may pass through the cigarette 2000 and be delivered to the user.

As illustrated, the aerosol generation device 1000 may include a battery 1100, a controller 1200, and the heater portion 1300. However, only the components relating to the embodiment of the present disclosure are illustrated in FIG. 8. Therefore, those of ordinary skill in the art to which the present disclosure pertains should understand that the aerosol generation device 1000 may further include general-purpose components other than the components illustrated in FIG. 8. For example, the aerosol generation device 1000 may further include a display configured to output visual information, a motor configured to output tactile information, and/or at least one sensor (puff sensor, temperature sensor, cigarette insertion sensor, etc.). Hereinafter, the components of the aerosol generation device 1000 will be described.

The battery 1100 may supply the power used to operate the aerosol generation device 1000. For example, the battery 1100 may supply power to allow the heater portion 1300 to be heated or may supply power required for the controller 1200 to operate. Also, the battery 1100 may supply power required to operate a display, a sensor, a motor, and the like (not illustrated) which are installed in the aerosol generation device 1000.

Next, the controller 1200 may control the overall operation of the aerosol generation device 1000. Specifically, the controller 1200 may control the operation of the battery 1100 and the heater portion 1300 and also control the operation of other components included in the aerosol generation device 1000. Also, the controller 1200 may check a state of each of the components of the aerosol generation device 1000 to determine whether the aerosol generation device 1000 is in an operable state.

The controller 1200 may include at least one processor. The processor may also be implemented with an array of a plurality of logic gates or implemented with a combination of a general-purpose microprocessor and a memory which stores a program that may be executed by the microprocessor. Also, those of ordinary skill in the art to which the present disclosure pertains should understand that the controller 1200 may also be implemented with other forms of hardware.

Next, the heater portion 1300 may heat the cigarette 2000 using the power supplied from the battery 1100. For example, when the cigarette 2000 is inserted into the aerosol generation device 1000, the heating element of the heater portion 1300 may be inserted into a partial region inside the cigarette 2000 and cause a temperature of an aerosol-forming substrate in the cigarette 2000 to rise.

In some embodiments, unlike in FIG. 8, the heater portion 1300 may include an external heating-type element. In this case, the heating element of the heater portion 1300 may be disposed outside the cigarette 2000 inserted into the aerosol generation device 1000. Also, unlike in the drawings, the heater portion 1300 may include a plurality of heating elements. For example, the heater portion 1300 may include a plurality of internal heating-type elements or a plurality of external heating-type elements. As another example, the heater portion 1300 may include one or more internal heating-type elements and one or more external heating-type elements.

The heating element may be made of an electrically resistive material or any material capable of induction heating. However, the material of the heating element is not limited thereto, and the heating element may be made of any other material as long as the material may be heated to a desired temperature by control of the controller 1200. Here, the desired temperature may be preset in the aerosol generation device 1000 or may be set by the user.

Meanwhile, although FIG. 8 illustrates a case in which the battery 1100, the controller 1200, and the heater portion 1300 are disposed in a row, the internal structure of the aerosol generation device 1000 is not limited to the example illustrated in FIG. 8. In other words, the arrangements of the battery 1100, the controller 1200, and the heater portion 1300 are disposed may vary according to the design of the aerosol generation device 1000.

Hereinafter, the hybrid-type aerosol generation devices 1000 will be described with reference to FIGS. 9 and 10. For clarity of the present disclosure, description of the components 1100, 1200, and 1300 which are the same as described above will be omitted.

As illustrated in FIG. 9 or 10, the aerosol generation device 1000 may further include a vaporizer 1400.

When the cigarette 2000 is inserted into the aerosol generation device 1000, the aerosol generation device 1000 may operate the heater portion 1300 and/or the vaporizer 1400 to generate an aerosol from the cigarette 2000 and/or the vaporizer 1400. The aerosol generated by the heater portion 1300 and/or the vaporizer 1400 may pass through the cigarette 2000 and be delivered to the user. When the cigarette 2000 is inserted into the aerosol generation device 1000, the heating element of the heater portion 1300 may come in contact with or be disposed adjacent to a partial region outside the cigarette 2000 and cause a temperature of an aerosol-forming substrate in the cigarette 2000 to rise.

The vaporizer 1400 may heat a liquid composition to generate an aerosol, and the generated aerosol may pass through the cigarette 2000 and be delivered to the user. In other words, the aerosol generated by the vaporizer 1400 may move along an air flow passage of the aerosol generation device 1000, and the air flow passage may be configured to allow the aerosol generated by the vaporizer 1400 to pass through the cigarette 2000 and be delivered to the user.

The vaporizer 1400 may include a liquid storage tank, a liquid delivering member, and a liquid heating element, but the present disclosure is not limited thereto. For example, the liquid storage tank, liquid delivering member, and liquid heating element may be included in the aerosol generation device 1000 as independent modules.

The liquid storage tank may store a liquid composition (that is, a liquid aerosol-forming substrate). The liquid storage tank may be manufactured to be detachable from the vaporizer 1400 or may be manufactured to be integrally formed with the vaporizer 1400.

Next, the liquid delivering member may deliver the liquid composition in the liquid storage tank to the liquid heating element. For example, the liquid delivering member may be a wick made of cotton fiber, ceramic fiber, glass fiber, or a porous ceramic, but is not limited thereto.

The liquid heating element is an element for heating the liquid composition delivered by the liquid delivering member. For example, the liquid heating element may be a metal heat wire, a metal heat plate, a ceramic heater, or the like, but is not limited thereto. Also, the liquid heating element may be made of a conductive filament such as a nichrome wire and may be disposed to be wound around the liquid delivering member. The liquid heating element may be heated by current supply of the controller 1200 and may deliver heat to the liquid composition, which is in contact with the liquid heating element, to heat the liquid composition. As a result, an aerosol may be generated.

As illustrated in FIG. 9 or 10, the vaporizer 1400 and the heater portion 1300 may be disposed in parallel or in series. However, the scope of the present disclosure is not limited to such arrangement forms.

For reference, the term "vaporizer" may be interchangeably used with the term "cartomizer" or "atomizer" in the art.

The controller 1200 may additionally control the operation of the vaporizer 1400, and the battery 1100 may also additionally supply power to allow the vaporizer 1400 to operate.

Various types of aerosol generation devices 1000 to which the aerosol-generating article 100 according to some embodiments of the present disclosure is applicable have been described above with reference to FIGS. 8 to 10.

Hereinafter, the configurations of the aerosol-generating article 100 described above and the advantageous effects according thereto will be described in more detail using examples and comparative examples. However, the examples are merely some examples of the present disclosure, and the scope of the present disclosure is not limited by the examples.

Comparative Example 1

A heating-type cigarette having the same structure as the aerosol-generating article 100 illustrated in FIG. 1 was manufactured. A hollow tube filter made of a cellulose acetate material having an inner diameter of about 2.5 mm was used as a support structure (e.g., the support structure 120), and a polylactic acid (PLA) woven material was used as a cooling structure (e.g., the cooling structure 130). Also, a transfer jet nozzle system (TJNS) filter (made of cellulose acetate material) to which about 6 mg of menthol flavoring liquid was added was used as a mouthpiece portion (e.g., the mouthpiece portion 140).

Example 1

A heating-type cigarette identical to that of Comparative Example 1 was manufactured except that a hollow tube filter made of a cellulose acetate material having an inner diameter of about 4.2 mm was used as a cooling structure (e.g., the cooling structure 130). An air dilution rate was set to 17%.

Example 2

A heating-type cigarette identical to that of Example 1 was manufactured except that a hollow tube filter made of a cellulose acetate material having an inner diameter of about 3.5 mm was used as a support structure (e.g., the support structure 120) and a cooling structure (e.g., the cooling structure 130).

Example 3

A heating-type cigarette identical to that of Example 1 was manufactured except that a hollow tube filter made of a cellulose acetate material having an inner diameter of about 4.2 mm was used as a support structure (e.g., the support structure 120) and a hollow tube filter made of a cellulose acetate material having an inner diameter of about 3.5 mm was used as a cooling structure (e.g., the cooling structure 130).

Example 4

A heating-type cigarette identical to that of Example 1 was manufactured except that a paper tube filter perforated so that an air dilution rate is about 17% was used as a cooling structure (e.g., the cooling structure 130). Specifically, a paper tube filter having a weight of about 103 mg, a length of about 14 mm, a thickness of about 0.52 mm, a total surface area of about 611 $mm^2$, a roundness of about 97%, and an inner diameter of about 6 mm was used.

Example 5

A heating-type cigarette identical to that of Example 4 was manufactured except that a hollow tube filter made of a cellulose acetate material having an inner diameter of about 3.0 mm was used as a support structure (e.g., the support structure 120).

Example 6

A heating-type cigarette identical to that of Example 4 was manufactured except that a hollow tube filter made of a cellulose acetate material having an inner diameter of about 3.6 mm was used as a support structure (e.g., the support structure 120).

Example 7

A heating-type cigarette identical to that of Example 4 was manufactured except that a hollow tube filter made of a cellulose acetate material having an inner diameter of about 4.2 mm was used as a support structure (e.g., the support structure 120).

Example 8

A heating-type cigarette identical to that of Example 4 was manufactured except that a paper tube filter having an inner diameter of about 7 mm was used as a cooling structure (e.g., the cooling structure 130).

Example 9

A heating-type cigarette identical to that of Example 4 was manufactured except that a non-perforated paper tube filter having an air dilution rate of about 0% was used as a cooling structure (e.g., the cooling structure 130).

Example 10

A heating-type cigarette identical to that of Example 4 was manufactured except that a paper tube filter, which was made by an on-line perforation method so that an air dilution rate was about 10%, was used as a cooling structure (e.g., the cooling structure 130).

Example 11

A heating-type cigarette identical to that of Example 4 was manufactured except that a paper tube filter, which was made by an on-line perforation method so that an air dilution rate was about 30%, was used as a cooling structure (e.g., the cooling structure 130).

Example 12

A heating-type cigarette identical to that of Example 4 was manufactured except that a paper tube filter, which was made by an on-line perforation method so that an air dilution rate was about 45%, was used as a cooling structure (e.g., the cooling structure 130).

Table 2 below summarizes the structures of the cigarettes according to Comparative Example 1 and Examples 1 to 12.

TABLE 2

| Classification | Medium portion | Support structure | Cooling structure | | Mouthpiece portion |
|---|---|---|---|---|---|
| Comparative Example 1 | Same | Acetate tube Ø2.5 | PLA women material | | Acetate fiber + flavoring |
| Example 1 | | Acetate tube Ø2.5 | Acetate tube Ø4.2 | Dilution rate 17% | |
| Example 2 | | Acetate tube Ø3.5 | Acetate tube Ø3.5 | | |
| Example 3 | | Acetate tube Ø4.2 | Acetate tube Ø3.5 | | |
| Example 4 | | Acetate tube Ø2.5 | Paper tube Ø6.0 | Dilution rate 17% | |
| Example 5 | | Acetate tube Ø3.0 | | | |
| Example 6 | | Acetate tube Ø3.6 | | | |
| Example 7 | | Acetate tube Ø4.2 | | | |
| Example 8 | | Acetate tube Ø2.5 | Paper tube Ø7.0 | | |
| Example 9 | | Acetate tube Ø2.5 | Paper tube Ø6.0 | Dilution rate 0% | |
| Example 10 | | Acetate tube Ø2.5 | | Dilution rate 10% | |
| Example 11 | | Acetate tube Ø2.5 | | Dilution rate 30% | |
| Example 12 | | Acetate tube Ø2.5 | | Dilution rate 45% | |

Experimental Example 1: Analysis of Smoke Components According to Inner Diameter Difference An experiment was conducted to analyze smoke components of the cigarettes according to Comparative Example 1 and Examples 1 to 8. Specifically, smoke components of mainstream smoke were analyzed during smoking of cigarettes produced two weeks beforehand, and the experiment was conducted according to Health Canada (HC) smoking conditions using an automatic smoking device in a smoking room with a temperature of about 20° C. and a humidity of about 62.5%. The smoke for component analysis was repeatedly collected three times for each sample, based on eight puffs per time. The average values of three collected results are shown in Table 3 below.

TABLE 3

| Classification | | Nic. (mg/cig.) | PG (mg/cig.) | Gly. (mg/cig.) | Moisture (mg/cig.) |
|---|---|---|---|---|---|
| Comparative Example 1 | Ø2.5mm/ PLA | 1.04 | 0.56 | 3.67 | 30.8 |
| Example 1 | Ø2.5 mm/ Ø4.2 mm | 1.03 | 0.52 | 3.98 | 29.3 |
| Example 2 | Ø3.5 mm/ Ø3.5 mm | 0.71 | 0.47 | 2.48 | 28.8 |

TABLE 3-continued

| Classification | | Nic. (mg/cig.) | PG (mg/cig.) | Gly. (mg/cig.) | Moisture (mg/cig.) |
|---|---|---|---|---|---|
| Example 3 | Ø4.2 mm/ Ø3.5 mm | 0.71 | 0.46 | 2.47 | 28.1 |
| Example 4 | Ø2.5 mm/ Ø6.0 mm | 1.14 | 0.5 | 5.1 | 30.2 |
| Example 5 | Ø3.0 mm/ Ø6.0 mm | 1.13 | 0.48 | 5.09 | 30.4 |
| Example 6 | Ø3.6 mm/ Ø6.0 mm | 1.11 | 0.51 | 4.98 | 31.2 |
| Example 7 | Ø4.2 mm/ Ø6.0 mm | 1.09 | 0.49 | 4.55 | 27.9 |
| Example 8 | Ø2.5 mm/ Ø7.0 mm | 1.18 | 0.53 | 5.43 | 31.9 |

Referring to Table 3, the amounts of propylene glycol and moisture did not show significant differences between the examples and the comparative example, but the migration amounts of nicotine and glycerin showed differences according to the type of cooling structure and the inner diameter difference.

Specifically, it can be seen that the migration amounts of glycerin and nicotine tend to generally increase with an increase in the inner diameter difference. This seems to be due to the air flow diffusion effect and the removal capacity decreasing effect (e.g., with an increase in the inner diameter, an amount of filter material is reduced and the removal capacity is decreased) according to the inner diameter difference.

In particular, in the case of Example 1, the migration amount of glycerin was increased as compared to when the more expensive PLA cooling structure was used. In this way, it can be seen that vapor production may be increased and product cost may be reduced as compared to the comparative example through an appropriate inner diameter combination of a support structure (e.g., the support structure 120) and a cooling structure (e.g., the cooling structure 130).

Also, in the cases of Examples 4 to 8 (Examples 4 and 8, in particular), the migration amounts of glycerin and nicotine noticeably increased as compared to the comparative example. This seems to be due to a significant decrease in the removal capacity of the filter and maximization of the inner diameter difference due to applying a paper tube filter.

Experimental Example 2: Measurement of Mainstream Smoke Temperature According to Inner Diameter Difference In order to identify cooling performance according to the inner diameter difference between a support structure (e.g., the support structure 120) and a cooling structure (e.g., the cooling structure 130), an experiment was conducted to measure a mainstream smoke temperature of the cigarettes according to Comparative Example 1 and Examples 1 to 8. Specifically, the mainstream smoke temperature was measured during smoking of cigarettes produced two weeks beforehand, and the results of measurement are shown in Table 4 below.

TABLE 4

| Classification | | Mainstream smoke temperature (° C.) |
|---|---|---|
| Comparative Example 1 | Ø2.5mm/PLA | 59.1 |
| Example 1 | Ø2.5 mm/Ø4.2 mm | 59.2 |
| Example 2 | Ø3.5 mm/Ø3.5 mm | 62.1 |
| Example 3 | Ø4.2 mm/Ø3.5 mm | 62.4 |
| Example 4 | Ø2.5 mm/Paper tube Ø6.0 mm | 56.3 |
| Example 5 | Ø3.0 mm/Paper tubeØ6.0 mm | 57.1 |
| Example 6 | Ø3.6 mm/Paper tubeØ6.0 mm | 57.5 |
| Example 7 | Ø4.2 mm/Paper tubeØ6.0 mm | 58.1 |
| Example 8 | Ø2.5 mm/Paper tubeØ7.0 mm | 55.1 |

Referring to Table 4, the mainstream smoke temperature generally decreased with an increase in the inner diameter difference between a support structure (e.g., the support structure 120) and a cooling structure (e.g., the cooling structure 130). For example, in the case of Example 8 with the largest inner diameter difference, the mainstream smoke temperature was the lowest.

Also, in the case of Example 1, it can be seen that the cooling performance was almost the same as compared to when the more expensive PLA cooling structure was used. That is, it can be seen that sufficient cooling performance may be secured while reducing the product cost through an appropriate inner diameter combination of a support structure (e.g., the support structure 120) and a cooling structure (e.g., the cooling structure 130).

In conclusion, through the above experimental results, it can be seen that the performance of a cooling structure (e.g., the cooling structure 130) may be significantly improved as the air flow diffusion effect due to the inner diameter difference increases the area and time of contact between the mainstream smoke and outside air. Also, referring back the result shown in Table 3, it can be seen that the improvement in cooling performance may also enhances vapor production.

Experimental Example 3: Additional Experiment According to Air Dilution Rate

An experiment was conducted to analyze smoke components of the cigarettes according to Example 4 and Examples 9 to 12. The smoke component analysis was performed in the same way as in Experimental Example 1, and the mainstream smoke temperature measurement was performed in the same way as in Experimental Example 2. The experimental results are shown in Table 5 below. In Table 5 below, the experimental results of Comparative Example 1 and Example 1 were gathered from Tables 3 and 4.

TABLE 5

| Classification | | Nic. (mg/cig.) | PG (mg/cig.) | Gly. (mg/cig.) | Moisture (mg/cig.) | Mainstream smoke temperature (° C.) |
|---|---|---|---|---|---|---|
| Comparative Example 1 | 02.5/PLA | 1.04 | 0.56 | 3.67 | 30.8 | 59.1 |
| Example 1 | 02.5/04.2 | 1.03 | 0.52 | 3.98 | 29.3 | 59.2 |
| Example 4 | Paper tube (17%) | 1.14 | 0.5 | 5.1 | 30.2 | 56.3 |
| Example 9 | Paper tube (0%) | 1.06 | 0.54 | 3.82 | 30.6 | 59.6 |
| Example 10 | Paper tube (10%) | 1.16 | 0.54 | 5.22 | 33 | 56.9 |
| Example 11 | Paper tube (30%) | 1.13 | 0.45 | 5.22 | 28.2 | 53.2 |
| Example 12 | Paper tube (45%) | 0.96 | 0.37 | 3.94 | 20.7 | 48.1 |

Referring to Table 5, the amounts of propylene glycol and moisture did not show significant differences between the examples and the comparative example (except for Examples 11 and 12), but the migration amounts of nicotine and glycerin showed differences according to the air dilution rate.

Specifically, in the case of Example 1 in which a cellulose acetate tube filter was applied as a cooling structure, the migration amount of glycerin increased as compared to Comparative Example 1, and in the cases of Example 4 and Examples 10 to 12 in which a perforated paper tube filter was applied as a cooling structure, the migration amounts of glycerin and nicotine both increased as compared to Comparative Example 1.

Also, in all of the cases of Example 4 and Examples 9 to 12, a mainstream smoke temperature dropped significantly as compared to Comparative Example 1, and it was found that the temperature tends to drop linearly with an increase in the air dilution rate. This seems to be due to minimization of thermal deformation of the mouthpiece portion, a decrease in removal capacity, dilution with an appropriate amount of outside air, and the air flow diffusion effect according to the inner diameter difference.

Therefore, it can be seen that a tubular structure having an appropriate air dilution rate may significantly improve cooling performance as compared to the comparative example and may also improve vapor production and the taste of tobacco.

Meanwhile, although not shown in Table 5, it was found that thermal deformation of the mouthpiece portion occurred somewhat excessively in the case of Example 9 in which a non-perforated paper tube was applied, as compared to other examples. This seems to be a reason for a relative decrease in the migration amount of glycerin.

Also, in Example 12, an amount of air diluted in the paper tube increased, which seems to be a reason for the lowest mainstream smoke temperature and a decrease in the migration amounts of nicotine and glycerin. Also, although not shown in Table 5, false puffs, which did not occur in other examples, occurred in the case of Example 12. Therefore, it can be seen that, preferably, the air dilution rate should be less than or equal to about 45% in order to prevent vapor production reduction and false puffs.

Experimental Example 4: Smoking Sensory Evaluation

For the cigarettes according to Comparative Example 1 and Examples 1, 2, and 4, an experiment was conducted to carry out sensory evaluation of smoking satisfaction. Specifically, sensory evaluation was carried out for vapor production, vapor production stability, draw resistance, mainstream smoke heat, tobacco smoke taste intensity, irritation, off-taste, and overall tobacco taste of the cigarettes. The sensory evaluation was carried out by a panel of twenty-five evaluators, based on a scale of 5 points, using cigarettes produced two weeks beforehand. The results of the sensory evaluation are shown in Table 6 below.

TABLE 6

| Classification | Comparative Example 1 (02.5/ PLA) | Example 1 (02.5/ 04.2) | Example 2 (03.5/ 03.5) | Example 4 (02.5/ Papertube 06.0) |
|---|---|---|---|---|
| Vapor production | 3.37 | 3.66 | 3.32 | 4.06 |
| Vapor production stability | 4.17 | 4.2 | 4.05 | 4.32 |
| Draw resistance | 3.7 | 4.01 | 3.9 | 3.97 |
| Mainstream smoke heat | 3.59 | 3.7 | 3.82 | 3.52 |
| Tobacco smoke taste intensity | 3.93 | 3.81 | 3.78 | 4 |
| Irritation | 3.72 | 3.68 | 3.64 | 3.61 |
| Off-taste | 3.51 | 3.49 | 3.44 | 3.48 |
| Overall tobacco taste | 3.78 | 3.85 | 3.68 | 4.1 |

Referring to Table 6, in the cases of Examples 1 and 4 in which an inner diameter difference is present between a support structure (e.g., the support structure 120) and a cooling structure (e.g., the cooling structure 130), the vapor production and vapor production stability were found to be improved as compared to Comparative Example 1 in which PLA was applied, and the overall tobacco taste was also found to be improved. In particular, in the case of Example 4 in which a paper tube filter was applied to maximize the inner diameter difference, the vapor production, vapor production stability, and overall tobacco taste were found to be significantly improved as compared to Comparative Example 1.

Also, in the cases of Examples 1 and 4, the off-taste was found to be reduced as compared to Comparative Example 1. This seems to be due to an improvement in the flavor expressing property of the cigarette and an increase in the migration amount of nicotine which are due to a decrease in removal capacity and an increase in air flow diffusion according to the inner diameter difference.

The configurations of the aerosol-generating article 100 described above and the advantageous effects according thereto have been described in more detail using various examples and comparative examples.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. An aerosol-generating article comprising:

a medium portion;

a support structure which is disposed downstream of the medium portion and includes a first tubular structure having a first hollow;

a cooling structure which is disposed downstream of the support structure and includes a second tubular structure which has a second hollow and is made of a cellulose acetate material; and a mouthpiece portion which is disposed downstream of the cooling structure, wherein an upstream end of the second tubular structure abuts a downstream end of the first tubular structure, the first tubular structure contains a plasticizer, and an average cross-sectional area of the second hollow is larger than an average cross-sectional area of the first hollow.

2. The aerosol-generating article of claim 1, wherein the average cross-sectional area of the second hollow is at least 1.5 times larger than the average cross-sectional area of the first hollow.

3. The aerosol-generating article of claim 1, wherein an inner diameter ratio of the first tubular structure to the second tubular structure is in a range of 1:1.25 to 1:2.

4. The aerosol-generating article of claim 1, wherein an inner diameter difference between the first tubular structure and the second tubular structure is in a range of 1 mm to 2.5 mm.

5. The aerosol-generating article of claim 1, wherein:

an inner diameter of the first tubular structure is in a range of 2.0 mm to 3.0 mm; and an inner diameter of the second tubular structure is in a range of 3.5 mm to 5.0 mm.

6. The aerosol-generating article of claim 1, wherein the first tubular structure is made of the cellulose acetate material.

7. The aerosol-generating article of claim 6, wherein the second tubular structure has a higher plasticizer content than the first tubular structure.

8. The aerosol-generating article of claim 7, wherein a plasticizer content ratio of the first tubular structure to the second tubular structure is in a range of 1:1.2 to 1:2.

9. The aerosol-generating article of claim 1, wherein a cross-sectional area of a first portion of the second hollow is smaller than a cross-sectional area of a second portion thereof.

10. The aerosol-generating article of claim 1, wherein a length of the cooling structure is at most 3.5 times larger than an inner diameter of the second tubular structure.

11. The aerosol-generating article of claim 1, wherein the mouthpiece portion includes a cellulose acetate filter.

12. An aerosol-generating article comprising:

a medium portion;

a support structure which is disposed downstream of the medium portion and includes a first tubular structure having a first hollow;

a cooling structure which is disposed downstream of the support structure and includes a second tubular structure which has a second hollow and is made of a cellulose acetate material; and a mouthpiece portion which is disposed downstream of the cooling structure, wherein an upstream end of the second tubular structure abuts a downstream end of the first tubular structure, an average cross-sectional area of the second hollow is larger than an average cross-sectional area of the first hollow, the mouthpiece portion includes a cellulose material having a bulk of 1.5 $cm^3/g$ or more; and a liquid moisturizing material is added to the cellulose material.

* * * * *